US007922633B2

(12) United States Patent
Januszek

(10) Patent No.: US 7,922,633 B2
(45) Date of Patent: Apr. 12, 2011

(54) EXERCISE DEVICE

(75) Inventor: Richard Zdzislaw Januszek, Peterborough (GB)

(73) Assignee: Escape Fitness Limited, Peterborough, Cambridgeshire (GB)

( * ) Notice: Subject to any disclaimer, the term of this patent is extended or adjusted under 35 U.S.C. 154(b) by 0 days.

(21) Appl. No.: 11/678,662

(22) Filed: Feb. 26, 2007

(65) Prior Publication Data

US 2007/0287611 A1 Dec. 13, 2007

(30) Foreign Application Priority Data

Jun. 13, 2006 (GB) ..... 0611625.5

(51) Int. Cl.
*A63B 21/072* (2006.01)
*A63B 23/00* (2006.01)

(52) U.S. Cl. ..... 482/108; 482/107; 482/148

(58) Field of Classification Search ..... 482/50, 482/92–94, 97–98, 106–109, 148
See application file for complete search history.

(56) References Cited

U.S. PATENT DOCUMENTS

| | | | | |
|---|---|---|---|---|
| 1,270,034 | A * | 6/1918 | Krudop | 482/107 |
| 1,946,208 | A * | 2/1934 | Hampton | 473/349 |
| 2,452,458 | A * | 10/1948 | Hahn | 403/24 |
| 3,151,404 | A * | 10/1964 | Schott | 434/191 |
| 3,171,652 | A * | 3/1965 | Newman | 482/106 |
| 3,482,834 | A * | 12/1969 | Forrest, Jr. | 482/108 |
| 3,502,326 | A * | 3/1970 | Schaeffer | 482/40 |
| 4,601,466 | A * | 7/1986 | Lais | 482/98 |
| 5,180,166 | A * | 1/1993 | Schmidt et al. | 473/332 |
| 5,407,413 | A * | 4/1995 | Kupferman | 482/106 |
| 5,445,587 | A * | 8/1995 | Brown | 482/108 |
| 5,484,367 | A * | 1/1996 | Martinez | 482/107 |
| 5,628,716 | A * | 5/1997 | Brice | 482/106 |
| 5,911,651 | A * | 6/1999 | Liu | 482/108 |
| 6,074,327 | A * | 6/2000 | Franklin | 482/37 |
| 6,261,211 | B1 * | 7/2001 | Suarez et al. | 482/107 |
| 6,312,364 | B1 * | 11/2001 | Selsam | 482/93 |
| 6,602,169 | B1 * | 8/2003 | Patti | 482/107 |
| 6,776,741 | B2 * | 8/2004 | Burwell | 482/108 |
| 6,874,856 | B2 * | 4/2005 | Yoshimura et al. | 301/5.21 |
| 6,971,974 | B2 * | 12/2005 | Bowman et al. | 482/107 |
| 7,001,310 | B1 * | 2/2006 | Brice | 482/10 |
| 7,025,713 | B2 * | 4/2006 | Dalebout et al. | 482/107 |
| 7,037,245 | B2 * | 5/2006 | Burwell | 482/108 |
| 7,048,678 | B2 * | 5/2006 | Harms et al. | 482/107 |
| D545,927 | S * | 7/2007 | Lien | D21/681 |
| D546,908 | S * | 7/2007 | Lien | D21/681 |
| 7,300,390 | B1 * | 11/2007 | Krull | 482/108 |
| D562,920 | S * | 2/2008 | Hillson | D21/681 |

(Continued)

FOREIGN PATENT DOCUMENTS

FR 2459056 A * 2/1981

(Continued)

*Primary Examiner* — Rinaldi I Rada
*Assistant Examiner* — Robert F Long
(74) *Attorney, Agent, or Firm* — Richard M. Goldberg

(57) ABSTRACT

A method of manufacturing an exercise device, includes the steps of providing a bar having an end portion; providing a collar for receiving the end portion; forming a weight section about the collar to form a weight assembly including a weight section and a collar; mounting the weight assembly on the end portion; providing a first securing member; and securing the weight assembly to the bar using the first securing member. The weight section is formed about the collar by casting.

43 Claims, 6 Drawing Sheets

U.S. PATENT DOCUMENTS

| | | | | |
|---|---|---|---|---|
| D567,311 | S * | 4/2008 | Hillson | D21/681 |
| 7,493,738 | B2 * | 2/2009 | Bui | 52/783.11 |
| 7,527,582 | B2 * | 5/2009 | Januszek | 482/108 |
| 2003/0197421 | A1 * | 10/2003 | Yoshimura et al. | 301/5.21 |
| 2003/0232705 | A1 * | 12/2003 | Harms et al. | 482/108 |
| 2004/0072662 | A1 * | 4/2004 | Landfair | 482/106 |
| 2005/0079961 | A1 * | 4/2005 | Dalebout et al. | 482/106 |
| 2007/0184945 | A1 * | 8/2007 | Lin | 482/107 |
| 2007/0197354 | A1 * | 8/2007 | Januszek | 482/107 |
| 2007/0249475 | A1 * | 10/2007 | Cao | 482/107 |
| 2007/0298939 | A1 * | 12/2007 | Anderson | 482/107 |
| 2007/0298940 | A1 * | 12/2007 | Anderson | 482/107 |
| 2008/0026920 | A1 * | 1/2008 | Berenshteyn | 482/106 |
| 2008/0026921 | A1 * | 1/2008 | Liu | 482/107 |
| 2008/0200315 | A1 * | 8/2008 | Lin | 482/106 |

FOREIGN PATENT DOCUMENTS

| | | | |
|---|---|---|---|
| GB | 2410197 | A * | 7/2005 |
| GB | 2439221 | A * | 12/2007 |

* cited by examiner

EXERCISE DEVICE

BACKGROUND OF THE INVENTION

The present invention relates to an exercise device, particularly but not exclusively to a dumbbell or barbell for weight lifting exercises and other fitness activities.

Conventional dumbbells or barbells comprise a bar and a set of weights mounted on the end portions of the bar. These dumbbells or barbells further comprise flanges and threaded securing means, such as a locking nut, to retain the weights in position on the bar and to secure the weights. The flanges are provided on the bar towards the end portions. The locking nuts are located on the end portions of the bar, over the weights, and are used to secure the weights on the bar by cooperating with the flanges to secure the weights therebetween.

These dumbbells or barbells have the problem that, through repeated use, the collars can become loose, thereby causing the weights to rotate, wobble and vibrate around the handle during use. This results in the dumbbell becoming awkward to use, and can eventually cause the weights to become disconnected from the bar, which can be extremely hazardous to the user.

Prior patent application GB2410197 seeks to address this problem by providing a dual fixing mechanism. The dumbbell of GB2410197 is provided with first and second securing members for securing the weight assembly to the end portion of the bar. The first securing member is a locking nut, which co-operates with a threaded portion on the bar, to force the weight against a flange section.

The second securing member comprises an end plate which engages with the weight. The end plate sits over the weight, and is held in place by means of a mounting screw, which engages with an internal thread in the end portion of the bar.

However, producing internal and external threads of a suitable quality for such an application, on a consistent basis, increases the cost of manufacturing a dumbbell. In addition, the high tensile screws which are required for the second fixing means also significantly add to the manufacturing cost, as well as being difficult to source. Furthermore, a thread locking compound, such as Loctite®, is required for dumbbells using threaded securing means, to prevent loosening, which again increases the cost per dumbbell.

The use of threaded securing means to retain the weight heads of a dumbbell in place also adds additional steps to the manufacturing process, which increases the manufacturing time and hence cost for each dumbbell. In addition to forming both the internal and external threads, the securing nut, and mounting screw must be attached and tightened, and the locking compound applied.

A poor tolerance between the end portion of a dumbbell bar and the inner bore of the weight head allows lateral movement of the bar within the inner bore, which eventually leads to wobbling and loosening of the securing means. However, for conventional dumbbells, the formation of a close tolerance bore between the weight head and the end portion of the bar is problematic. In particular, while the bar may be turned down to within relatively tight tolerances, it is difficult to achieve the same degree of accuracy when forming the bore within the weight head. This is mainly due to the low quality of the cast iron used to produce such weight heads at low cost.

SUMMARY OF THE INVENTION

The present invention aims to provide a dumbbell which obviates or mitigates the above described problems and/or provides improvements generally.

According to the present invention, there is provided a method of manufacturing an exercise device, as defined in the accompanying claims. There is further provided an exercise device, as defined in the accompanying claims.

In an embodiment of the invention, there is provided a method of manufacturing an exercise device, comprising the steps of providing a bar, the bar comprising an end portion; providing a collar for receiving the end portion; forming a weight section about the collar to form a weight assembly comprising a weight section and a collar; mounting the weight assembly on the end portion; providing a first securing member; and securing the weight assembly to the bar using the first securing member. The weight section is preferably formed about the collar by casting.

Forming the weight assembly about the collar, for example by casting, advantageously obviates the requirement for a subsequent manufacturing step to bore the weight. In addition, a collar made from pre-extruded steel may be used without requiring any machining to alter the diameter to fit the weight. Therefore, forming the weight about a collar removes several manufacturing steps, thereby reducing the time and cost of manufacture, as well as providing an improved fit between the end portion and the weight assembly. The improved fit assists in preventing loosening or fracture of the first securing member.

The weight section may be formed about the collar such that the collar is fixed relative to the weight section. In this way, the collar may be used as a second securing member, to secure the weight assembly to the end portion independently to the first securing member. To fix the collar relative to the weight section, a portion of the weight section extends inwardly of a portion of the collar.

Preferably, the collar comprises a longitudinal axis, and the collar is axially fixed relative to the weight section. The longitudinal axis of the collar is coaxial with the longitudinal axis of the bar, when the weight assembly is mounted in the bar.

The first securing member may comprise an end plate for engaging with the weight assembly to at least axially secure the weight assembly to the end portion. The end plate provides the advantage of distributing the force securing the weight assembly over a large surface area of the weight assembly, as well as obscuring the end portion of the bar, and any other securing members, from view. The end plate allows the display of logos, weight numbers or other information.

To secure the weight assembly to the end portion of the bar using the first securing member, the end plate may be secured to the end portion. Preferably, the end portion comprises a projection, and the step of securing the end plate to the end portion comprises welding the end plate to the projection. Alternatively, the step of securing the end plate to the end portion may comprise flaring the projection to retain the end plate against the weight assembly. Flaring the projection has the advantage of permanently securing the end plate to the projection, without requiring welding, the high temperature of which can be problematic as it can cause melting of the polyurethane outer skin.

The method may comprise the steps of providing a resilient member, applying a force to the end plate to compress the resilient member prior to the step of securing the end plate to the end portion, such that the resilient member remains compressed when the end plate is secured to the end portion and the force is removed from the end plate. In this way, the compressed resilient member provides a force to secure the weight assembly on the bar. Preferably, the weight assembly comprises an outer skin, and the outer skin comprises the resilient member. The end plate is pressed against the upper surface of the weight assembly such that it compresses the outer skin.

In another embodiment, the end plate comprises a first and a second projection. The second projection is located in the aperture of the end plate, and extends from the first projection. The height of the first projection is selected such that the end plate contacts and is supported by the first projection when the resilient member is compressed.

In another embodiment, the method further comprises the steps of providing a second securing member for securing the weight assembly to the bar, and securing the weight assembly to the bar using the second securing member. Preferably, the collar comprises the second securing member.

An interference fit preferably exists between the collar and the end portion. The collar has an inner diameter, and the end portion has an outer diameter, the inner diameter of the collar and the outer diameter of the end portion being selected such that an interference fit exists therebetween. The interference fit prevents or limits axial, lateral and rotational movement between the end portion and the collar. As the weight section is formed around the collar, preventing movement therebetween, relative movement between the end portion and the weight assembly is therefore prevented. An interference fit between the end portion and the weight assembly advantageously enables the weight assembly to be permanently secured to the end portion. The step of mounting the weight assembly on the bar comprises pressing the weight assembly onto the end portion. Preferably the distal end of the end portion is tapered to provide a lead-in for the collar.

The method may further comprise providing a third securing member for securing the weight assembly to the bar, and securing the weight assembly to the bar using the third securing member. Preferably, the third securing member is a weld. Providing three securing members ensures that the dumbbell remains secure should one or both of the other securing members fail. In addition, each securing member works to maintain the integrity of the other two. Preferably, each securing member secures the weight assembly independently of the others.

Preferably, the collar comprises an outer surface, and the method further comprises the step of forming at least one channel in the outer surface of the collar. At least one channel may extend around at least part of the periphery of the collar. In addition, or alternatively, at least one channel may extend along the length of the collar. The channels extending around the periphery of the collar prevent axial movement of the collar relative to the weight section. The channels extending along the length of the collar prevent rotational movement of the collar relative to the weight section.

In an embodiment of a further aspect of the invention, there is provided an exercise device comprising a bar, the bar comprising an end portion; a weight assembly mounted on the end portion; and a first securing member for securing the weight assembly to the bar. The weight assembly comprises a collar and a weight section formed about the collar. The collar is adapted to receive the end portion of the bar to mount the weight assembly on the bar. The collar is therefore located between the end portion and the weight section, which enables a high tolerance fit to be achieved between the end portion and the weight assembly. Furthermore, by forming the weight section about the collar, it is possible to provide a closer surface to surface fit than can be achieved by machining the weight section. This advantageously prevents or minimises movement between the collar and the weight section, and hence the end portion and the weight assembly. Preventing such movement provides the further advantage of enabling a permanent first fixing member, such as a weld, to be provided, or preventing loosening of a non-permanent first fixing member.

Preferably, the weight section is formed about the collar such that the collar is fixed relative to the weight section. A portion of the weight section extends inwardly of a portion of the collar to fix the collar relative to the weight section.

The exercise device may further comprise a resilient member which is compressed when the end plate is secured to the end portion of the bar to secure the weight assembly to the bar. Preferably, the weight assembly comprises an outer skin, which may comprise the resilient member. The end plate may be rotationally fixed relative to the weight assembly.

The collar preferably comprises an outer surface about which the weight section is formed, the outer surface having at least one channel into which a portion of the weight section extends.

The end plate may be rotationally fixed relative to the weight assembly. Preferably, the end plate is recessed into the outer skin of the weight assembly. The end plate may be provided with at least one projection which cooperates with the weight assembly to prevent rotation of the end plate relative to the weight assembly.

In an embodiment of yet a further aspect of the invention, there is provided a method of manufacturing an exercise device, comprising providing a bar comprising an end portion and a locating member; providing a weight assembly; providing a resilient member; mounting the weight assembly on the end portion; providing an end plate for cooperating with the locating member to secure the weight assembly to the bar; applying a force to the end plate to cause the end plate to compress the resilient member; securing the end plate to the end portion while the resilient member is compressed; and removing the force once the end plate is secured to the end portion. The compressed resilient member applies a force to urge the weight assembly against the locating member.

BRIEF DESCRIPTION OF THE DRAWINGS

The invention will now be described by way of example only, and with reference to the accompanying drawings in which:—

DETAILED DESCRIPTION

Figure 1:
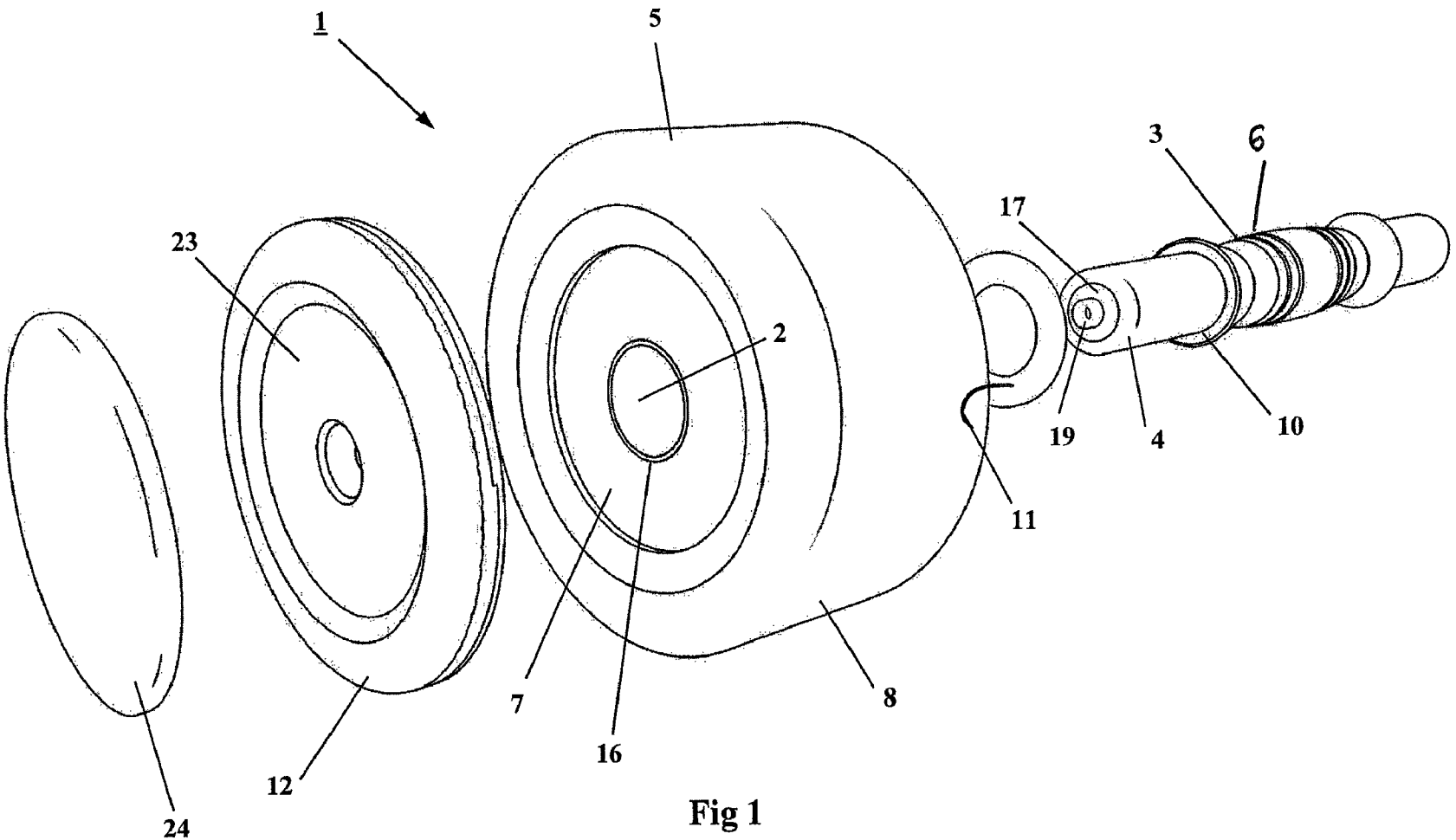
FIG. 1 presents an exploded view of a dumbbell according to an embodiment of the invention.

Referring to FIG. 1, the exercise device 1 comprises a bar 3 having end portions 4 at each end. The exercise device 1 further comprise a weight assembly 5 which is mounted on an end portion 4 of the bar 3, with a second weight assembly mounted on the opposite end of the bar. The central portion of the bar comprises a handle portion 6. The weight assembly 5 is axially retained on an end portion 4 of the bar 3 in one direction by a locating member 10. The locating member 10 may be a projection, such as a flange, or a collar. Preferably, a washer 11 is provided between the locating member 10 and the weight assembly 5. The washer 11 is preferably formed of hardened steel and acts to distribute the load from the locating member over a wider surface area of the lower surface of the weight assembly, as well as improving the surface contact between the locating member and the weight assembly, thereby reducing any wobble between the bar 3 and the weight assembly 5.

The weight assembly 5 comprises an inner weight section 7, and an outer skin 8. The inner weight section 7 is preferably formed from cast iron, although other suitable materials could also be used. The outer skin 8 is preferably formed of rubber, polyurethane, or any other suitable resilient material, and is moulded over the inner weight section 7. The outer skin 8 protects the inner weight section from damage and corrosion, as well as providing an aesthetically pleasing finish. A central bore 2 is formed in the weight assembly for receiving the end portion 4 of the bar 3.

Cast iron is commonly used to form dumbbell weights, as its density enables a weight of suitable size to be achieved, while also being relatively cheap to purchase and form into the required shape. However, cast iron used to produce weight assemblies at a commercially viable cost is often not of suitable quality to enable a smooth surface finish to be achieved. Therefore, when a bore is formed in a cast iron weight to accommodate the end portion of a bar, it is not possible to provide an interference fit between the end portion and the weight, as the required tolerances cannot be achieved. In addition, the surface imperfections are such that the end portion does not sit completely flush with the inner surface of the bore. Hence, there is movement between the end portion and weight, which results in loosening of the fixings securing the weight to the bar.

To address this problem, there is provided in an embodiment of the present invention a collar 16, for receiving the end portion 4 of the bar 3. The collar 16 is located between the end portion 4, and the inner weight section 7. The collar 16 is preferably cylindrical, and surrounds the periphery of the end portion 4. Preferably, the collar 16 extends along the entire length of the central bore 2 of the weight assembly 5. The collar is preferably formed from seamless mild steel tubing, but may also be formed from any other suitable material.

In contrast to the cast iron of the inner weight section 7, the collar 16 may be easily machined to tight tolerances, and may be provided with a smooth surface finish. As such, an interference fit may be provided between the end portion 4 and the collar 16, to prevent or limit movement therebetween. In particular, the interference fit prevents relative axial and rotational movement between the end portion 4 and the collar 16. In this way, the collar 16 provides a securing member, which has the advantage of obviating the requirement for threaded fastenings.

The collar 16 is provided to prevent movement between the end portion 4 and the weight assembly 5. Therefore, as well as achieving a suitably toleranced fit between the collar 16 and the end portion 4, it is also necessary to ensure that any movement between the collar 16 and the weight assembly 5 is prevented. For the reasons discussed above in relation to the end portion 4, it is not possible to machine a bore in the inner weight section 7 suitable for providing a close fit with the collar 16. Therefore, the inner weight section 7 is formed around the collar 16 during the casting process. As such, the inner weight section 7 forms to the outer surface of the collar 16. The collar obviates the need for subsequent machining of the inner weight section 7. Furthermore, the closest possible tolerance between the collar 16 and the inner weight section 7 is achieved, which prevents lateral movement therebetween.

Figure 2:
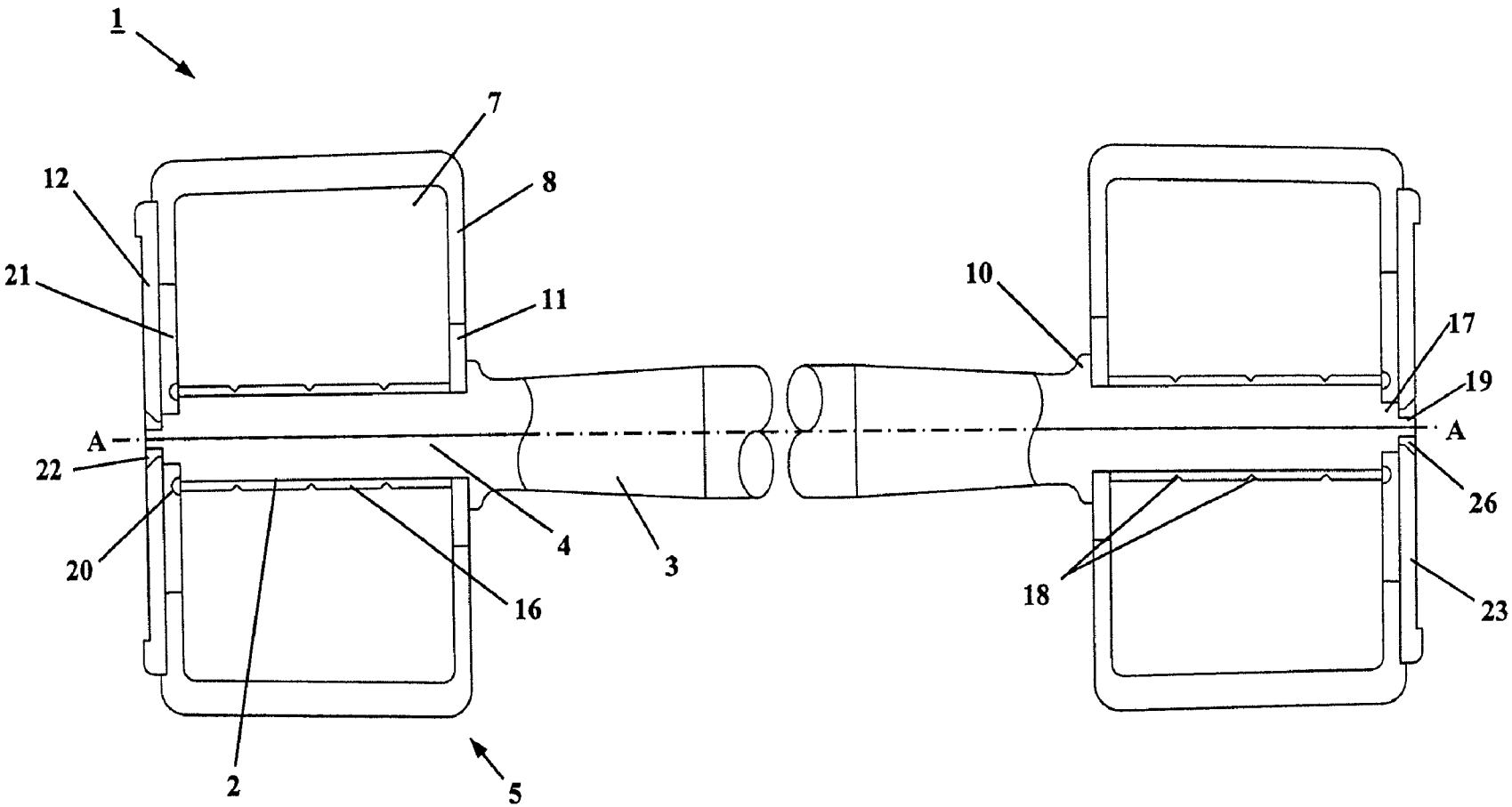
FIG. 2 presents a section view of the dumbbell of FIG. 1.

The collar 16 comprises a longitudinal axis, as shown by line A-A in FIG. 2. The longitudinal axis of the collar 16 is coaxial with the longitudinal axis of the bar 3 when the weight assembly 5 is mounted on the end portion 4. To prevent relative axial movement between the collar 16 and the weight assembly 5, a portion of the inner weight section 7 extends into the collar 16, or vice versa. Preferably, the collar is provided with at least one annular channel 18. The channel 18 is machined into the outer surface of the collar 16, and preferably extends around its entire periphery. During the casting process, the molten inner weight section 7 penetrates into the channel 18 and solidifies. The inner weight section 7 is thus formed such that a portion of the inner weight section 7 extends into the collar 16. The interaction between the channel 18 and the portion of the inner weight section 7 extending into the collar 16, prevents axial movement between the inner weight section 7 and the collar 16. In the embodiment of the invention shown in FIG. 3, the collar 16 is provided with three channels 18, although such is not essential and other numbers may be provided. The collar 16 may also be provided with channels 18 extending along its length to prevent rotational movement between the collar 16 and the weight assembly 5.

In an alternative embodiment, the collar 16 may be provided with projections which radially extend away from its outer surface. The projections may comprise one or more radially extending ridges arranged around the periphery and/or axially, one or more dimples, a secondary collar, or any other member which radially extends away from the surface of the collar. The collar 16 may also be provided with channels 18 extending around the outer surface in a spiral or helical formation, such that the channels 18 restrict movement in both the radial and axial directions. The collar 16 may also be provided with both projections and recessed sections. In a further alternative embodiment, the outer surface of the collar 16 may be tapered along the length of the collar 16, such that the ends of the collar 16 are both of greater diameter than some point along the length of the outer surface of the collar, or such that the ends of the collar 16 are both of lesser diameter than some point along the length of the collar 16.

A first securing member is provided to secure the weight assembly 5 to the end portion 4. The first securing member may comprise an end plate 12. The end plate 12 secures the weight assembly 5 to the end portion 4 independently of the collar 16. It is necessary to provide a securing member in addition to the collar, as for all but the lightest of weights an interference fit is not sufficient to permanently secure a weight on a dumbbell bar. Preferably, the end plate 12, comprises a load bearing plate (not shown), and an outer skin 25. The outer skin is moulded around the load plate in a similar manner to the outer skin 8 of the weight assembly 5.

The end plate 12 further comprises a central aperture 26. The end plate 12 covers a recess 21 in the outer skin 8 of the weight assembly 5, with the peripheral edge of the end plate 12 supported by the outer skin 8. The end plate 12 is further supported about the central aperture 26 by a first projection 17 extending from the end portion 4. Preferably, the first projection 17 is of reduced diameter relative to the end portion 4. A second projection 19, of reduced diameter relative to the first projection 17, extends from the first projection 17 and within the central aperture 26.

Figure 6A:
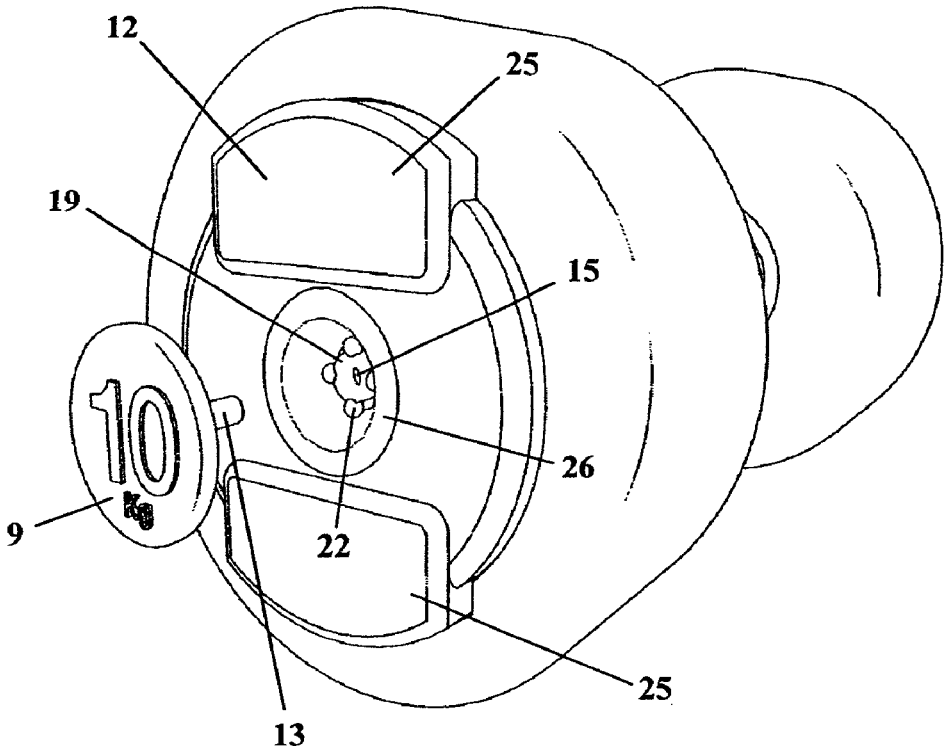
FIG. 6*a* presents a perspective view of a dumbbell with the number disc removed, according to yet another embodiment of the invention.

The second projection 19 may comprise a bore 15 extending through its centre, as shown in FIG. 6*a*. The bore 15 may extend downwards into the first projection 17, and into the main body of the end portion 4. The bore 15 is provided to receive the spigot 13 of the number disc 9. The disc 9 may be used to display information relating to the weight of the dumbbell, logos, or other information or designs. The spigot 13 extends from the rear surface of the disc 9, and is received by the bore 15. The end plate 12 may comprise a recess 23 for receiving the disc 9, such that the disc 9 is flush with the surface of the end plate 12. The disc 9 obscures the weld 20, and second projection 19 from view. In the same way, the end plate 12 obscures the end portion 4 from view.

The end plate 12 is secured to the end portion 4 of the bar 3. In one embodiment, the end plate 12 is secured to the end portion 4 by a weld 22. The weld is formed in the central aperture 26 of the end plate 12, and surrounds the second projection 19. Preferably the central aperture 26 is tapered, or counter-sunk to retain the weld more securely. The weld 26 provides a permanent fixing, and obviates the need for a threaded fastener such a locking nut. Previously, it has not been possible to use a weld to permanently fix the weight assembly of a dumbbell, as movement between the end portion of the bar and the weight assembly would result in the weld cracking. However, the present invention provides a collar 16 which is cast into, and fixed relative to, the weight assembly 5, and which provides an interference fit with the end portion 4. As such, movement between the end portion 4 and the weight assembly 5 is prevented, thereby enabling the use of welds as a permanent fixing means. In a further advantage, by obviating the requirement for threaded fastenings, it is no longer required to provide the inner weight section 7 with a recess to accommodate the fastening below the upper surface of the weight assembly 5.

In an alternative embodiment, the end plate 12 is secured by flaring the second projection member 19. The second projection is provided with a central bore. The end plate 12 is placed onto the upper surface of the weight assembly 5 such that the second projection 19 extends within the central aperture 26. A tapered tool is then inserted into the central bore of the second projection 19 and a force applied such that the end of the second projection 19 is expanded in diameter. The expanded diameter of the second projection 19 is forced against the countersunk central aperture 26 of the end plate 12, and secures the end plate 12 is position.

Threaded fastenings are commonly used in the arrangements of the prior art as they allow a torque to be applied to the fastening to urge the weight assembly against the locating means of the bar, which is not possible with a passive securing means such as a weld. This problem is overcome in the present invention using the resilient force of the outer skin 8.

During assembly of the dumbbell, the end plate 12 is placed onto the outer skin 8 such that the central aperture is aligned with the second projection 19. A force is applied to the upper surface of the end plate 12, for example using a press such as a 40 tonne press, thereby compressing the portion of the outer skin 8 supporting the end plate 12. The height of the first projection 17 is selected such that it is a predetermined distance below the upper surface of the outer skin 8, which contacts and supports the end plate 12. The outer skin 8 is compressed until the end plate 12 contacts the first projection 17. The end plate 12 is then held in place and secured to the end portion 4 with a weld, by flaring the end of the second projection 19, or by any other suitable means. When the compressive force is subsequently removed, the outer skin 8 remains compressed. Due to its resilient properties, the compressed outer skin 8 applies a force to the weight assembly to urge it against the locating member 10.

In addition to the end plate 12 and the collar 16, a third securing member 20 may be provided to secure the weight assembly 5 to the end portion 4, independently of the end plate 12 and the collar 16. The third securing member 20 is preferably a weld, such as a ring weld, which connects the end portion 4, the collar 16, and the upper surface of the inner weight section 7 of the weight assembly 5. Each of the three securing members, comprising the collar 16, the end plate 12, and the third securing member 20, secures the weight assembly 5 to the end portion 4 independently of each other. The weight assembly may therefore be secured to the end portion by one of the three securing members alone, by two of the securing members in combination, or using all three. The third securing member 20 is obscured from view by the end plate 12.

Figure 3:
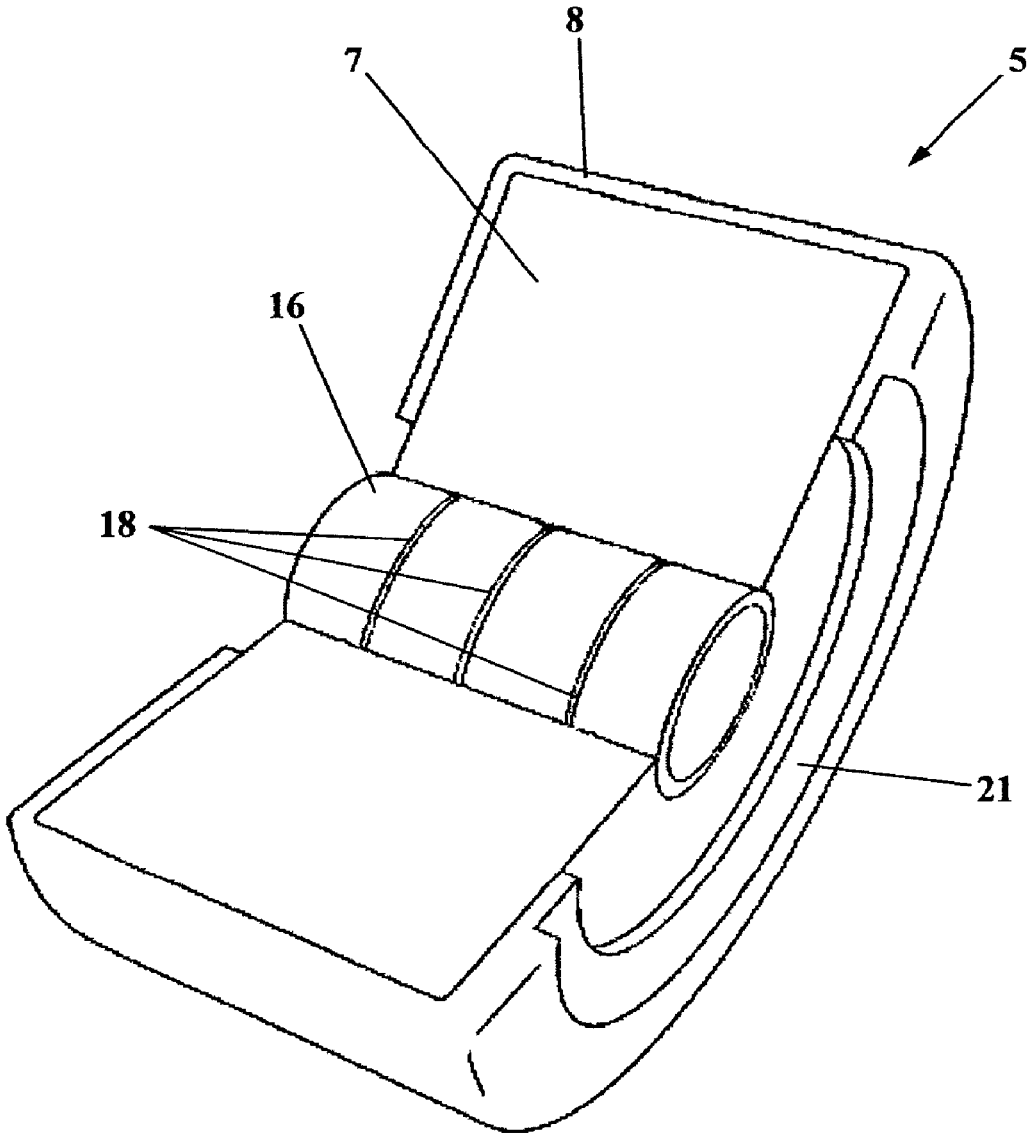
FIG. 3 presents a cut away view of a weight assembly of FIG. 1 or 2.
Figure 4:
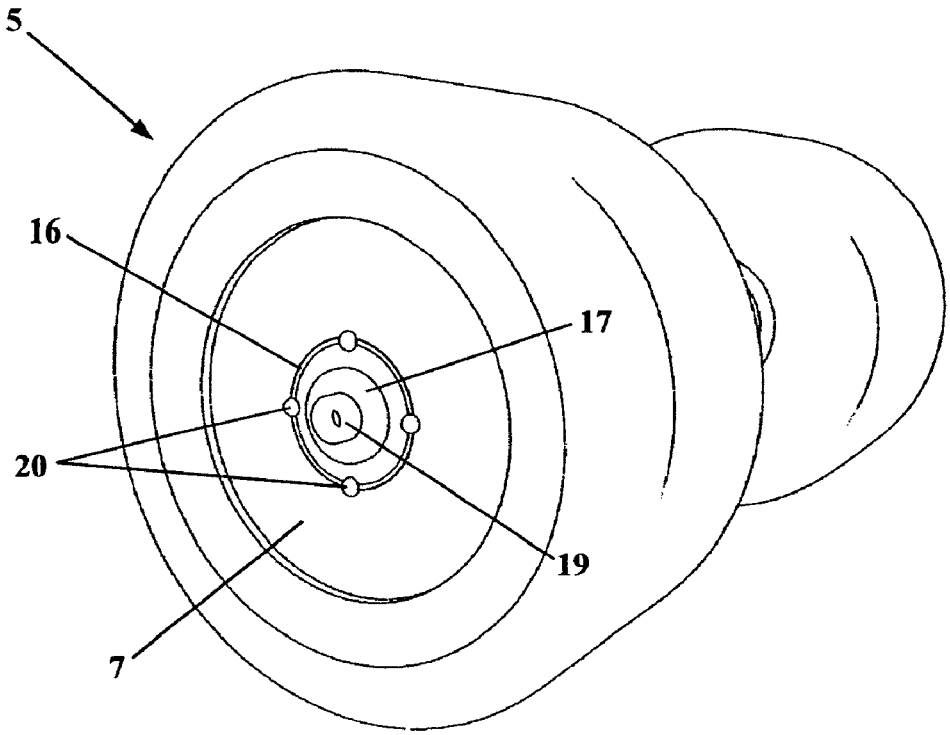
FIG. 4 presents a perspective view of a dumbbell having the end plate removed, according to an alternative embodiment of the invention.
Figure 5:
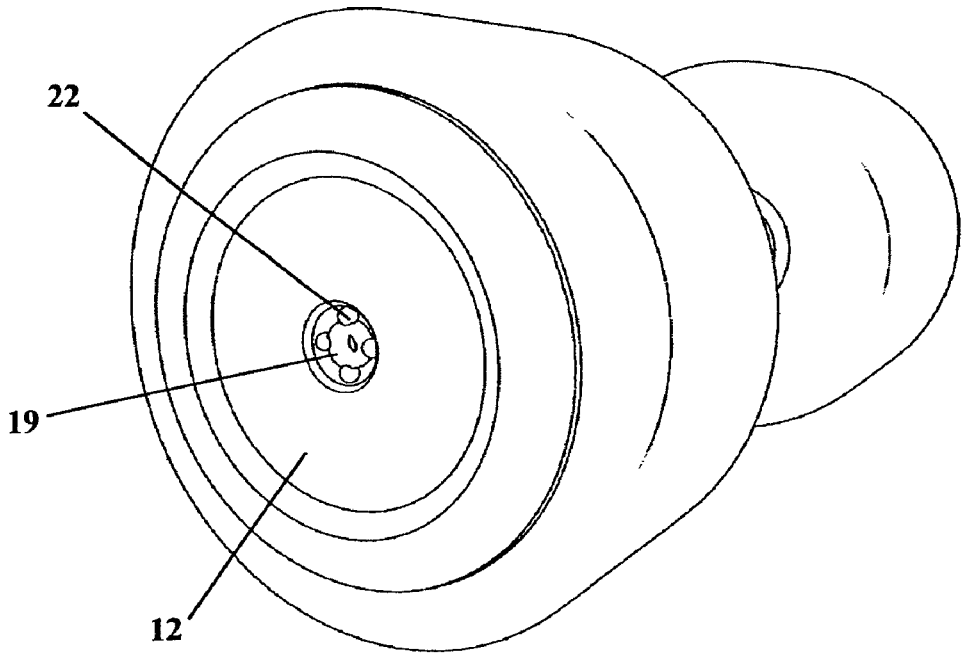
FIG. 5 presents a perspective view of a dumbbell according to a further alternative embodiment of the invention.
Figure 6B:
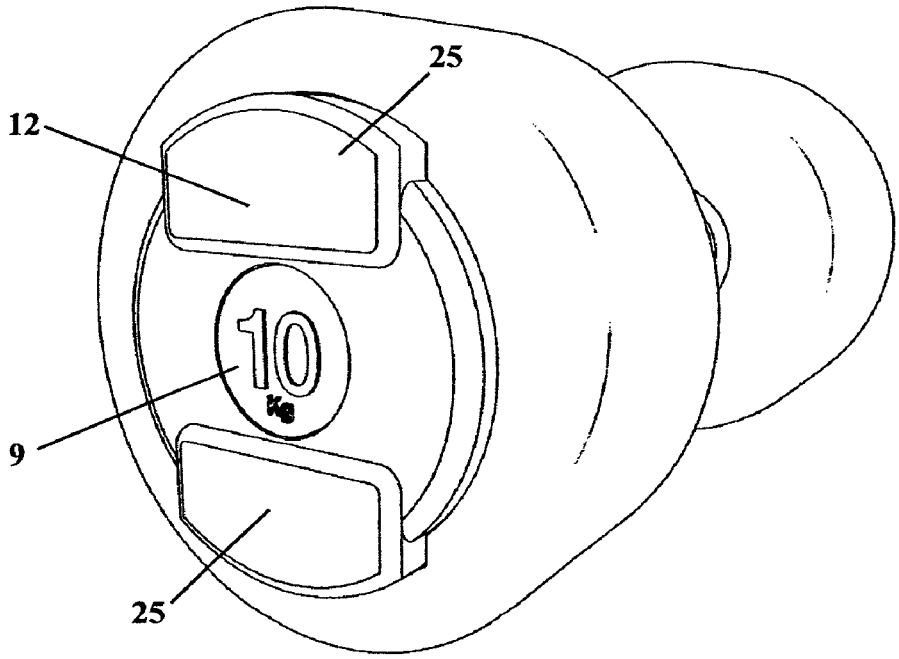
FIG. 6*b* presents a perspective view of the dumbbell of FIG. 6*a* with the number disc inserted.
Figure 7:
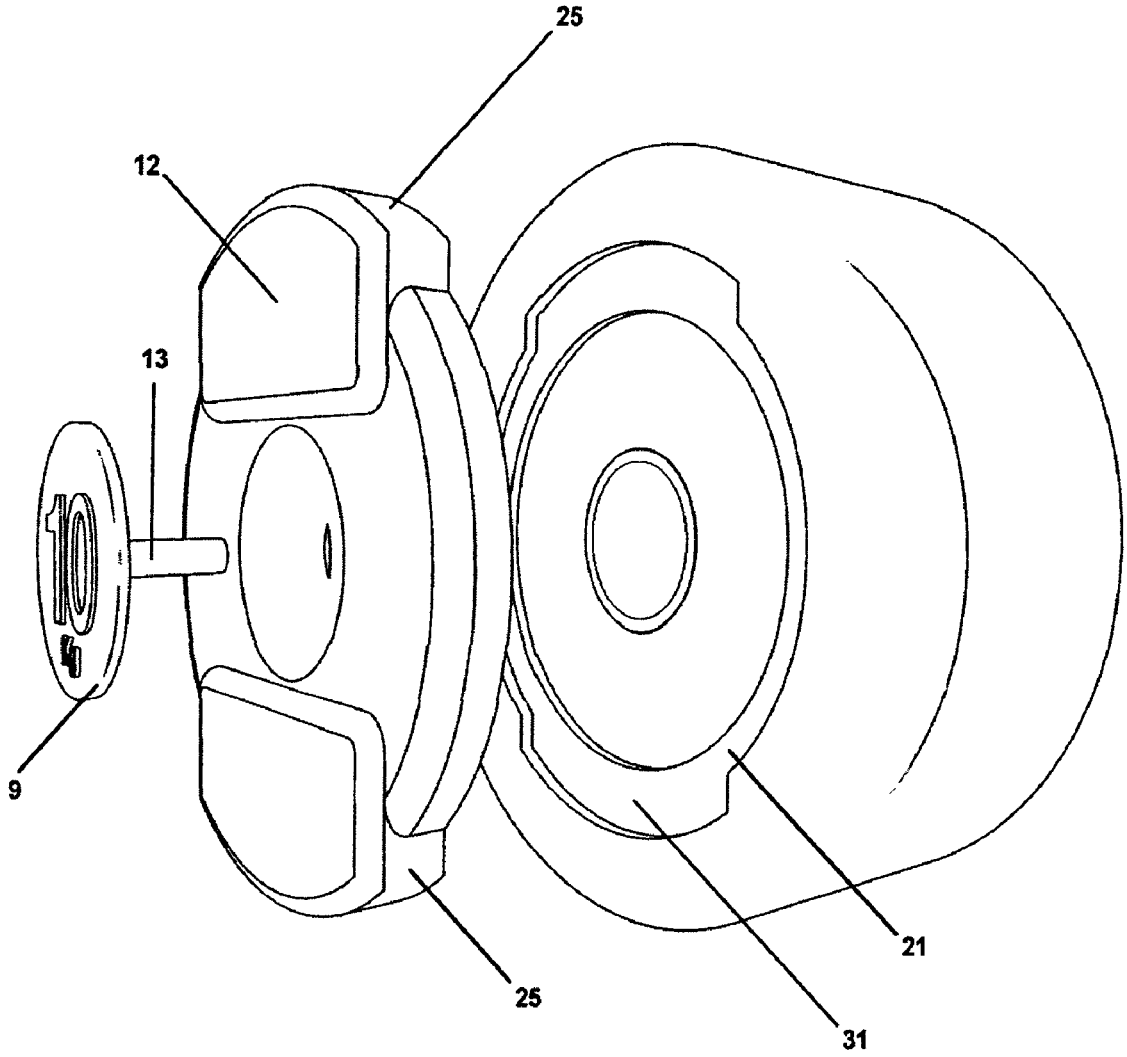
FIG. 7 presents an exploded view of the weight assembly and end plate of FIGS. 6*a* and 6*b*.

In an alternative embodiment, there is provided a recess 21 in the weight assembly 5, as shown in FIG. 3, adapted to receive the end plate 12. Preferably the recess is provided in the outer skin 8 of the weight assembly 5. The end plate 12, as shown in FIGS. 6*a*, 6*b*, and 7, comprises a main body and projections 25. Preferably there are provided two projections 25, formed from the outer skin. The recess 21 is shaped such that it corresponds in shape to the end plate 12. Rotational movement of the end plate 12 is prevented by the engagement of the projections 25 with the recess 21. Lateral or radial movement of the end plate 12 relative to the weight assembly 5 is prevented by the side walls of the recess 21.

It will be appreciated that in further embodiments various modifications to the specific arrangements described above and shown in the drawings may be made. For example, it is evident that the construction for securing the weights on the bar is not limited to applications in dumbbells or barbells but can also be applied to secure weights in other exercise equipment applications.

What is claimed is:

1. A method of manufacturing an exercise device, comprising the steps of:

providing a bar, the bar comprising an end portion;

providing a collar for receiving the end portion, the collar having an inner bore and an outer surface;

forming a first surface feature including one of a projection and a recess in the outer surface of the collar;

casting a weight section about the collar to form a weight assembly comprising the weight section and the collar, the weight section having a bore with an inner surface;

forming a second surface feature including the other of a projection and a recess in the inner surface of the weight section when the weight section is formed about the collar during the casting step;

fixing the collar relative to the weight section during the casting step, by engaging one of the first and second surface features into the other of the first and second surface features to interlock the first and second surface features with each other when the weight section is cast about the collar;

mounting the weight assembly on the end portion;

providing a first securing member;

securing the weight assembly to the bar using the first securing member.

2. The exercise device of claim 1, wherein the collar has a longitudinal axis, and wherein the collar is axially fixed relative to the weight section.

3. The exercise device of claim 1, wherein the first surface feature includes a recess and the second surface feature of the weight section includes a projection which extends inwardly of the recess of the collar to fix the collar relative to the weight section.

4. The method of claim 1, wherein the step of forming a first surface feature comprises the step of forming at least one channel in the outer surface of the collar as said first surface feature.

5. The method of claim 4 wherein the at least one channel extends around at least part of the periphery of the collar.

6. The method of claim 5 wherein the at least one channel includes a plurality of channels and at least one said channel extends at least partially along the length of the collar.

7. The method of claim 1, wherein the first securing member comprises an end plate, and further comprising the step of engaging the end plate with the weight assembly to at least axially secure the weight assembly to the end portion.

8. The method of claim 7, wherein the end plate comprises a central aperture, and the end portion of the bar comprises a projection, and further comprising the step of locating the projection within the central aperture of the end plate.

9. The method of claim 8, further comprising the step of securing the end plate to the end portion by welding the end plate to the projection.

10. The method of claim 8, further comprising the step of securing the end plate to the end portion by flaring the projection to retain the end plate against the weight assembly.

11. The method of claim 1, further comprising the steps of providing a resilient member, and applying a force to the first securing member to compress the resilient member prior to the step of securing the first securing member to the end portion, such that the resilient member remains compressed when the first securing member is secured to the end portion and the force is removed from the first securing member.

12. The method of claim 11, wherein the weight assembly further comprises an outer skin, and wherein the resilient member comprises a resilient portion of the outer skin.

13. The method of claim 1, further comprising the step of providing a second securing member to further secure the weight assembly to the bar.

14. The method of claim 13, wherein the second securing member comprises the collar.

15. The method of claim 13, further comprising the steps of providing a third securing member for securing the weight assembly to the bar, and securing the weight assembly to the bar using the third securing member.

16. The method of claim 15, wherein the third securing member comprises a weld.

17. The method of claim 1, wherein an interference fit exists between the collar and the end portion.

18. The method of claim 1, wherein the weight section is cast iron.

19. The method of claim 1, wherein the exercise device is a dumbbell.

20. The method of claim 1 wherein the at least one surface feature comprises at least one recess formed in the outer surface of the collar, and the step of fixing includes the step of extending the weight section into the at least one recess when the weight section is formed about the collar.

21. The method of claim 1 wherein the first surface feature comprises at least one projection extending from the outer surface of the collar, the second surface feature comprises at least one recess in the inner surface of the weight section, and the step of fixing includes the step of extending the projection into at least one recess in the weight section when the weight section is cast about the collar.

22. An exercise device comprising:

a bar, the bar comprising an end portion;

a weight assembly mounted on the end portion and comprising:

a collar, and a weight section cast about the collar, the collar having an outer surface and an inner bore adapted to receive the end portion of the bar to mount the weight assembly on the bar, the outer surface of the collar having a first surface feature including one of a projection and a recess;

the weight section having a bore with an inner surface, and the inner surface having a second surface feature including the other of a projection and a recess which is formed when the weight section is cast about the collar;

one of the first and second surface features being engaged within the other of the first and second surface features to interlock the first and second surface features with each other when the weight section is cast about the collar to fix the collar relative to the weight section; and a first securing member for securing the weight assembly to the bar.

23. The exercise device of claim 22, wherein the collar has a longitudinal axis, and wherein the collar is axially fixed relative to the weight section.

24. The exercise device of claim 22, wherein a portion of the weight section extends inwardly of a portion of the collar to fix the collar relative to the weight section.

25. The exercise device of claim 22, wherein the second surface feature includes at least one projection and the first surface feature includes at least one channel into which the at least one projection of the weight section extends.

26. The exercise device of claim 25, wherein at least one said channel extends around at least part of the periphery of the collar.

27. The exercise device of claim 25 wherein the at least one channel includes a plurality of channels and at least one said channel extends at least partially along the length of the collar.

28. The exercise device of claim 22, wherein the first securing member comprises an end plate for engaging with the weight assembly to at least axially secure the weight assembly to the end portion.

29. The exercise device of claim 28, wherein the end plate comprises a central aperture, and the end portion comprises a projection located within the central aperture of the end plate, and wherein the projection cooperates with the end plate to secure the weight assembly to the end portion.

30. The exercise device of claim 29, wherein the projection is welded to the end plate.

31. The exercise device of claim 29, wherein the projection is flared to retain the end plate against the weight assembly.

32. The exercise device of claim 28, wherein the end plate is rotationally fixed relative to the weight assembly.

33. The exercise device of claim 22, further comprising a resilient member which is compressed when the first securing member is secured to the end portion of the bar to secure the weight assembly to the bar.

34. The exercise device of claim 33, wherein the resilient member comprises an outer skin of the weight assembly.

35. The exercise device of claim 22, further comprising a second securing member for securing the weight assembly to the bar, wherein the second securing member comprises the collar.

36. The exercise device of claim 35, further comprising a third securing member for securing the weight assembly to the bar.

37. The exercise device of claim 36, wherein the third securing member is a weld.

38. The exercise device of claim 22, wherein an interference fit is provided between the collar and the end portion.

39. The exercise device of claim 22, wherein the exercise device is a dumbbell.

40. The exercise device of claim 22 wherein the first surface feature comprises at least one recess formed in the outer surface of the collar, the second surface feature comprises at least one projection extending from the inner surface of the weight section, and the at least one projection of the weight section extends into the at least one recess when the weight section is cast about the collar.

41. The method of claim 22 wherein the first surface feature comprises at least one projection extending from the outer surface of the collar, the second surface feature comprises at least one recess in the inner surface of the weight section, and the at least one projection extending into the at least one recess in the weight section when the weight section is cast about the collar.

42. A method of manufacturing an exercise device, comprising the steps of:

providing a bar comprising an end portion and a locating member;

providing a weight assembly;

providing a resilient member;

mounting the weight assembly on the end portion;

providing an end plate for cooperating with the locating member to secure the weight assembly to the bar;

applying a force to the end plate to cause the end plate to compress the resilient member;

securing the end plate to the end portion while the resilient member is compressed; and removing the force once the end plate is secured to the end portion;

wherein the compressed resilient member applies a force to urge the weight assembly against the locating member.

43. The method of claim 42, wherein the resilient member comprises a resilient portion of an outer skin of the weight assembly.

* * * * *